US011655013B2

(12) United States Patent
Clegg

(10) Patent No.: US 11,655,013 B2
(45) Date of Patent: May 23, 2023

(54) PEDAL DRIVE MOUNT SYSTEM FOR WATERCRAFT

(71) Applicant: Dick's Sporting Goods, Inc., Coraopolis, PA (US)

(72) Inventor: William E. Clegg, Gibsonia, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 341 days.

(21) Appl. No.: 17/062,352

(22) Filed: Oct. 2, 2020

(65) Prior Publication Data

US 2022/0106027 A1 Apr. 7, 2022

(51) Int. Cl.

| | |
|---|---|
| ***B63H 16/20*** | (2006.01) |
| ***B63H 20/02*** | (2006.01) |
| ***B63H 20/04*** | (2006.01) |
| ***B63B 34/50*** | (2020.01) |

(52) U.S. Cl.

CPC ..... *B63H 16/20* (2013.01); *B63B 34/50* (2020.02); *B63H 20/02* (2013.01); *B63H 20/04* (2013.01); *B63H 2016/202* (2013.01)

(58) Field of Classification Search

CPC ..... B63H 16/20; B63H 2016/202; B63H 20/007; B63H 20/02; B63H 20/04; B63H 20/06; B63H 20/10; B63H 20/106

USPC ..... 248/640–643

See application file for complete search history.

(56) References Cited

U.S. PATENT DOCUMENTS

| | | | | |
|---|---|---|---|---|
| 2,782,744 | A * | 2/1957 | Thomasg | B63H 20/10 248/642 |
| 4,129,088 | A * | 12/1978 | Foley, Jr. | B63H 20/007 440/63 |
| 4,459,116 | A | 7/1984 | Moore | |
| 6,712,653 | B2 | 3/2004 | Free | |
| 7,513,810 | B1 * | 4/2009 | Pelini | B63H 20/10 440/61 R |
| 7,549,902 | B2 | 6/2009 | Jansen | |
| 9,533,746 | B1 | 1/2017 | Garrett | |
| 9,623,944 | B2 | 4/2017 | Kuehmichel et al. | |
| 9,701,367 | B2 | 7/2017 | McDonough et al. | |

(Continued)

FOREIGN PATENT DOCUMENTS

| | | | |
|---|---|---|---|
| DE | 202016100212 | U1 | 4/2016 |
| KR | 20170013531 | A | 2/2017 |
| RU | 160943 | U1 | 4/2016 |

*Primary Examiner* — Ajay Vasudeva

(74) *Attorney, Agent, or Firm* — Foley & Lardner LLP

(57) ABSTRACT

An apparatus for mounting a pedal propulsion system to a watercraft, having a mount portion configured to be attached to the watercraft, a link support, and upper and lower links pivotally connected to the link support and to the mount portion. The link support and upper and lower links are configured to form part of a four-bar linkage arrangement and to simultaneously move together between an extended and lockable, operable position for operating the propulsion system, and a retracted and lockable, stowed position elevated above the extended position, for loading, transporting, unloading and/or launching the watercraft in the water. A column clamp is configured for selectively fixing a drive column of the pedal propulsion system to the link support, wherein the drive column, the link support and the upper and lower links are configured to simultaneously move together between the extended and retracted positions.

20 Claims, 12 Drawing Sheets

(56) References Cited

U.S. PATENT DOCUMENTS

| | | | | |
|---|---|---|---|---|
| 9,725,149 | B2 | 8/2017 | Kiffmeyer et al. | |
| 9,914,519 | B2 | 3/2018 | Nutz et al. | |
| 9,988,133 | B2 | 6/2018 | Murphy | |
| 10,220,924 | B1 | 3/2019 | Horvath et al. | |
| 11,034,423 | B2 | 6/2021 | Pelland et al. | |
| 11,332,227 | B2 * | 5/2022 | Clegg | B63H 16/20 |
| 11,447,220 | B2 * | 9/2022 | Bragg | B63B 34/20 |
| 2004/0262488 | A1 * | 12/2004 | Kozubski | B63H 20/106 248/642 |
| 2018/0001986 | A1 | 1/2018 | Nutz et al. | |
| 2018/0251201 | A1 | 9/2018 | Murphy | |

* cited by examiner

PEDAL DRIVE MOUNT SYSTEM FOR WATERCRAFT

BACKGROUND

The disclosure relates generally to a pedal drive system for watercraft, and in particular, to a pedal drive mounting system for watercraft such as kayaks.

Pedal-powered watercraft typically involve use of foot-operated pedals connected via a gear drive unit to a upright drive shaft portion, which is in turn connected to a propulsion unit, such as a propeller, positioned beneath the watercraft. Pedal-powered watercraft can offer advantages as compared to paddling in that a user's legs may be stronger than their arms, thereby potentially increasing the range and/or speed achievable by a user. This could be particularly significant if the user has problems with using their arms to perform paddling motions. Pedaling also frees up the user's hands, which can then be used for other activities, such as fishing, photography, etc. Additionally, because propulsion via pedaling reduces splashing of water, pedal propulsion may be quieter than paddling and may also reduce the likelihood of the user getting wet.

A potential disadvantage of a pedal powered watercraft, such as in the case of a kayak, is that the projection of the drive shaft portion and the propulsion unit beneath the kayak can make such a kayak more difficult to load, transport, unload and/or launch in the water.

Accordingly, providing a pedal propulsion unit of lower profile and/or changeable profiles may be desirable.

SUMMARY

Generally, example implementations of the present disclosure may include an apparatus for mounting a pedal propulsion system to a watercraft, and may include a mount portion configured to be integral with or attached to the watercraft, a link support and upper and lower links pivotally connected to the mount portion. The link support and upper and lower links are configured to form part of a four-bar linkage arrangement and to simultaneously move together between and extended position for operating the propulsion system and a retracted position elevated above the extended position. A column clamp may be configured for selectively fixing a drive column for the pedal propulsion system to the link support, wherein the drive column, the link support, and the upper and lower links are configured to simultaneously move together between the extended and retracted positions.

Example implementations of the present disclosure may include an apparatus for mounting a propulsion system to a watercraft and includes an elongated mount portion configured to be integral with or attached to the watercraft, the mount portion having a lower portion and an upper portion spaced above the lower portion. At least one elongated link support has a lower portion and an upper portion spaced above the lower portion of the link support, and at least one lower link has a first portion pivotally connected to the lower portion of the link support and a second portion pivotally connected to the lower portion of the mount portion. At least one upper link has a first portion connected to the upper portion of the link support and a second portion pivotally connected to the upper portion of the mount portion. The first portion of the lower link and the first portion of the upper link define an axis therebetween. The link support, the upper link, and the lower link are configured to move between a first position, wherein the link support is generally parallel to the mount portion, and a second position elevated above the first position. And, at least one column clamp is configured for receiving and substantially surrounding a drive column of a propulsion system of the watercraft and selectively fixing the drive column with respect to the link support.

Example implementations of the present disclosure may provide that upon the drive column being received by the column clamp and fixed with respect to the link support, the drive column extends generally parallel to the axis, and wherein the drive column, the link support, the upper link, and the lower link are configured to simultaneously move together between the first position and the second position.

Example implementations of the present disclosure can include the drive column being received by the column clamp and fixed with respect to the link support and/or the link support is configured to extend generally coplanar with the drive column.

Example implementations of the present disclosure may provide that the link support, the upper link, and the lower link are configured such that the link support is at least partially angled over the mounting portion in the second position relative to the first position.

Example implementations of the present disclosure may include at least one column cradle being configured for receiving and surrounding at least a portion of the drive column, at least one lug on the drive column, with the column cradle defining a recess configured to receive the lug, wherein, upon the drive column being received in the column cradle, the lug is received in the recess of the column cradle for positioning the drive column at preselected height with respect to the link support.

Example implementations of the present disclosure can have the mount portion extending generally vertically with respect to the watercraft and generally parallel to the drive column, upon the drive column being received by the column clamp and fixed with respect to the link support and/or the lower link and the upper link are approximately the same length and/or wherein the mount portion, the link support, the lower link and the upper link together form a four-bar linkage.

Example implementations of the present disclosure can provide that a first lower link and a second lower links are included, as are a first upper link and a second upper link and a first link support and a second link support. The column clamp extends between the first link support and the second link support, wherein upon the column clamp receiving and substantially surrounding the drive column, the first lower link and the first upper link are laterally spaced from a first side of the drive column and the second lower link and the second upper link are laterally spaced from a second, opposite side of the drive column.

Example implementations of the present disclosure may include the column clamp has a first member and a second member each defining a recess configured to receive at least a portion of the drive column, wherein the second member is pivotally connected to the first member.

Example implementations of the present disclosure may have a watercraft having a propulsion system including a propulsion unit and a drive column connected to the propulsion unit. An elongated mount portion has a lower portion and an upper portion spaced above the lower portion of the mount portion. At least one elongated link support has a lower portion and an upper portion spaced above the lower portion of the link support, and at least one lower link having a first portion pivotally connected to the lower portion of the link support and a second portion pivotally connected to the lower portion of the mount portion. At least one upper link has a first portion connected to the upper portion of the link support and a second portion pivotally connected to the upper portion of the mount portion. The first portion of the lower link and the first portion of the upper link define an axis therebetween. The link support, the upper link, and the lower link are configured to simultaneously move together between a first position, wherein the link support is generally parallel to the mount portion, and a second position, wherein the second position is elevated above the first position, and the link support is closer to the mounting portion in the second position relative to the first position. And, at least one column clamp is configured for receiving and substantially surrounding the drive column and selectively fixing the drive column with respect to the link support.

Example implementations of the present disclosure may provide upon the drive column being received by the column clamp and fixed with respect to the link support, the drive column extends generally parallel to the axis and generally coplanar with the link support, and wherein the drive column, the link support, the upper link, and the lower link are configured to simultaneously move together between the first position and the second position.

Example implementations of the present disclosure may include the watercraft can comprise the at least one column cradle being configured for receiving and generally surrounding a portion of the drive column, the mount portion can extend generally vertically with respect to the watercraft and generally parallel to the drive column (upon the drive column being received by the column clamp and fixed with respect to the link support) and/or the mount portion, the link support, the lower link and the upper link together form a four-bar linkage.

Example implementations of a watercraft of the present disclosure may provide that the mount portion includes a bracket having a laterally extending plate for attachment to or being integral with the watercraft, at least one lower projection extending generally perpendicularly from the plate and connected to the second portion of the lower link, at least one upper flange extending generally perpendicularly from the plate and connected to the second projection of the upper link, at least one ledge extending from the plate below the lower projection, and at least one flange on the lower link configured for engaging the ledge, wherein upon engagement of the flange with the ledge, the lower link and the upper link extend generally perpendicular to the plate, and the lower link is thereby restrained from pivoting downwardly.

Example implementations of the present disclosure may include an apparatus is described for mounting a propulsion system to a watercraft and includes an elongated mount portion configured to be attached to a watercraft, the mount portion having a lower portion and an upper portion spaced above the lower portion of the mount portion. At least one elongated link support has a lower portion and an upper portion spaced above the lower portion of the link support, and a first arm having a first portion pivotally connected to the link support and a second portion pivotally connected to a second arm. The second arm has a first portion connected to the mount portion, wherein the first arm and the second arm are configured to form a toggle lock, such that upon selective depression of the first portion of the first arm, at least one of the first arm and the second arm is placed in compression with respect to at least one of the link support and the mount portion. At least one link is pivotally connected to the link support and pivotally connected to the mount portion. The link support, the at least one link, the first arm, and the second arm are configured to move between a first position where the link support is generally parallel to the mount portion, and a second position where the second position is elevated above the first position, and at least one column clamp is configured for receiving and substantially surrounding a drive column of a propulsion system of the watercraft and selectively fixing the drive column with respect to the link support.

Example implementations of the present disclosure may provide the link comprising at least one lower link having a first portion pivotally connected to the lower portion of the link support and a second portion pivotally connected to the lower portion of the mount portion, and at least one upper link has a first portion connected to the upper portion of the link support and a second portion pivotally connected to the upper portion of the mount portion. And the first portion of the at least one lower link and the first portion of the at least one upper link define an axis therebetween.

Example implementations of the present disclosure may include a locking member movable between a locked position for securing the link support, the at least one link, the first arm, and the second arm in the second position, and an unlocked position for allowing movement of the link support, the at least one link, the first arm, and the second arm from the second position.

Example implementations of the present disclosure can include the locking member comprising a plate configured to be slidingly received in the at least one link and to move with respect to the at least one link between the locked position and the unlocked position.

Example implementations of the present disclosure may provide the locking member being configured to be slidingly received in the at least one link and to move with respect to the at least one link between the locked position and the unlocked position, and at least one releasable fastener selectively secures the locking member to the at least one link in the closed position.

Example implementations of the present disclosure may have the column clamp comprising a first portion and a second portion, the first portion being pivotally connected to the second portion, and the first portion of the column clamp is configured to move between an open position for receiving drive column and a closed position for engaging drive column. A releasable fastener selectively secures the clamp in the closed position. In still other example implementations of the present disclosure, the column clamp comprises a first portion having a first yoke configured for receiving the drive column and a second portion having a second yoke configured for receiving the drive column. The first portion is pivotally connected to the second portion, and the first portion of the column clamp is configured to move between an open position for receiving drive column and a closed position for engaging drive column, and the first portion defines an elongated channel, and the first yoke has a ridge configured to be received in an elongated channel. A releasable fastener selectively secures the clamp in the closed position.

Example implementations of the present disclosure may include the elongated mount comprises a first plate configured to be attached to a watercraft and a second plate configured to be attached to the first plate, wherein, the first portion of the second arm is pivotally connected the first plate and the at least one link is pivotally connected the first plate.

Example implementations of the present disclosure may provide that upon the drive column being received by the column clamp and fixed with respect to the link support, the link support is configured to extend generally coplanar with the drive column. In further example implementations of the present disclosure, the link support, the at least one link, the first arm, and the second arm are configured such that the link support is at least partially angled over the mounting portion in the second position relative to the first position. In still further example implementations of the present disclosure, at least one column cradle is configured for receiving and surrounding at least a portion of the drive column, and at least one lug is provided on the drive column. The column cradle defines a recess configured to receive the lug, where, upon the drive column being received in the column cradle, the lug is received in the recess of the column cradle for positioning the drive column at preselected height with the at least one lower link includes a first lower link and a second lower link, the at least one upper link includes a first upper link and a second upper link, the at least one link support includes a first link support and a second link support, and the column clamp extends between the first link support and the second link support, where upon the column clamp receiving and substantially surrounding the drive column, the first lower link and the first upper link are laterally spaced from a first side of the drive column and the second lower link and the second upper link are laterally spaced from a second side of the drive column, wherein the second side of the drive column is opposite the first side.

Example implementations of the present disclosure can include the mount portion, the link support, the lower link and the upper linking together to form a four-bar linkage.

Example implementations of the present disclosure may include a watercraft having a propulsion system including a propulsion unit, and drive column connected to the propulsion unit. An elongated mount portion has a lower portion and an upper portion spaced above the lower portion of the mount portion, and at least one elongated link support has a lower portion and an upper portion spaced above the lower portion of the link support. At least one lower link has a first portion pivotally connected to the lower portion of the link support and a second portion pivotally connected to the lower portion of the mount portion. At least one upper link has a first portion connected to the upper portion of the link support and a second portion pivotally connected to the upper portion of the mount portion. The first portion of the lower link and the first portion of the upper link defines an axis therebetween, and the link support, the upper link, and the lower link are configured to simultaneously move together between a first position, wherein the link support is generally parallel to the mount portion, and a second position, wherein the second position is elevated above the first position, and the link support is closer to the mounting portion in the second position relative to the first position. At least one column clamp is configured for receiving and substantially surrounding at least a portion of the drive column and selectively fixing the drive column with respect to the link support. A locking member is configured to move within the at least one lower link between a locked position for securing the link support, the at least one upper link, the at least one lower link, the first arm, and the second arm in the second position, and an unlocked position for allowing movement of the link support, the at least one upper link, the at least one lower link, the first arm, and the second arm from the second position. And, at least one releasable fastener selectively secures the locking member to the at least one lower link in the closed position.

Example implementations of the present disclosure may provide that the watercraft further comprises a first arm and a second arm, the first arm having a first portion pivotally connected to the link support and a second portion pivotally connected to the second arm, and the second arm having a first portion connected to the mount portion, where the first arm and the second arm are configured to form a toggle lock, such that upon selective depression of the first portion of the first arm, at least one of the first arm and the second arm is placed in compression with respect to at least one of the link support and the mount portion.

Example implementations of the present disclosure may include the column clamp of the watercraft further comprising a first portion having a first yoke configured for receiving the drive column and a second portion having a second yoke configured for receiving the drive column. The first portion is pivotally connected to the second portion, and the first portion of the column clamp is configured to move between an open position for receiving drive column and a closed position for engaging drive column. The first portion defines an elongated channel, and the first yoke has a ridge configured to be received in an elongated channel. A releasable fastener selectively secures the clamp in the closed position.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some implementations, the term "approximately" may include values that are within +/−10 percent of the value.

When used in this document, terms such as "top" and "bottom," "above" and "below", "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

Figure 1:
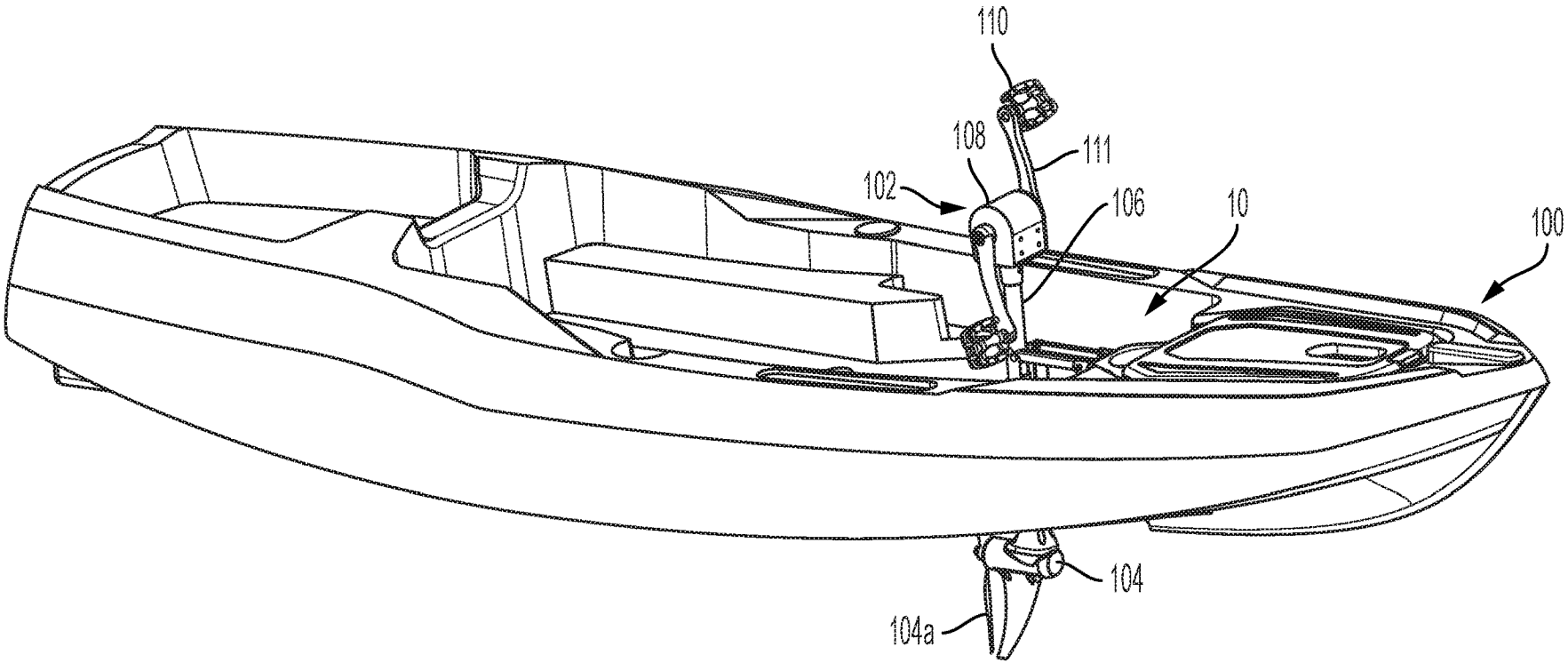
FIG. 1 is a right front perspective view of an example implementation of watercraft having a pedal drive mount system for watercraft of the present disclosure.

FIG. 1 presents a rear perspective view of an example implementation of watercraft having a pedal drive mount system, or apparatus, generally 10, in accordance with the present disclosure. The watercraft is shown in an example implementation as a kayak 100 and includes a propulsion system, generally, 102, having a propulsion unit 104 having a propeller 104*a*, which is driven by a drive shaft (not shown) within a drive column 106 connected to the propulsion unit 104. A right angle drive unit 108 is connected to the drive column 106, and pedals 110 are connected via crank arms 111 to the drive unit 108, such that upon rotation of pedals 110, drive unit 108 drives the drive shaft, which in turn drives propeller 104*a* of the propulsion unit 104.

As shown in FIGS. 2, 4, 5, and 6B, pedal drive mount system or apparatus 10 includes a four-bar linkage arrangement, generally 20, having an elongated mount, or mounting, portion 112 having a lower portion and an upper portion spaced above the lower portion of the mount portion 112. Mount portion 112, as shown in the figures, extends generally parallel to drive column and includes a laterally extending back plate 112*a*, which may be generally rectangular in shape. Mount portion 112 may be integral with, or connected to, a vertical portion 100*a* of kayak 100.

Figure 2:
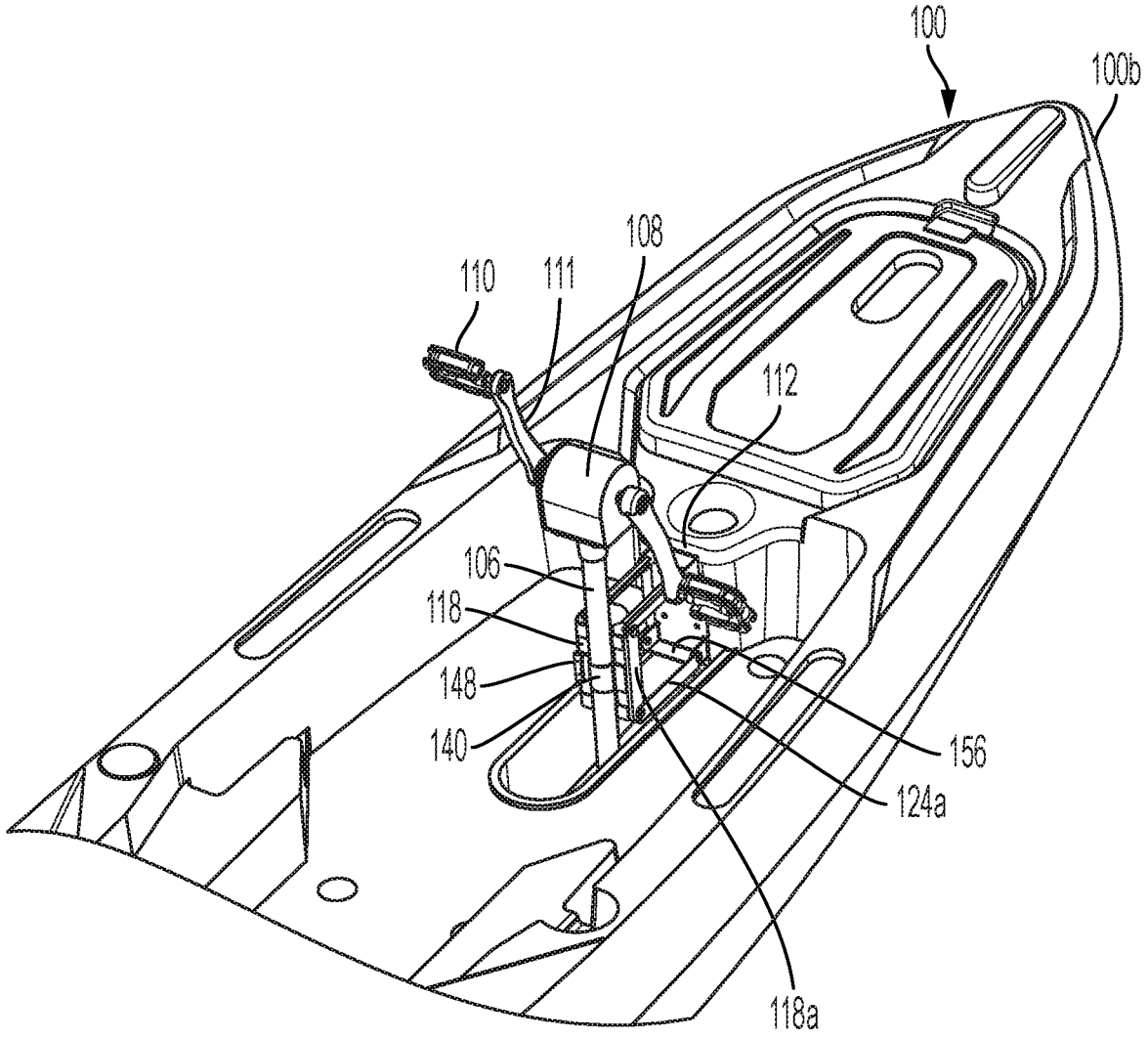
FIG. 2 is a right rear perspective view of an example implementation of a pedal drive mount system for watercraft of the present disclosure.
Figure 3:
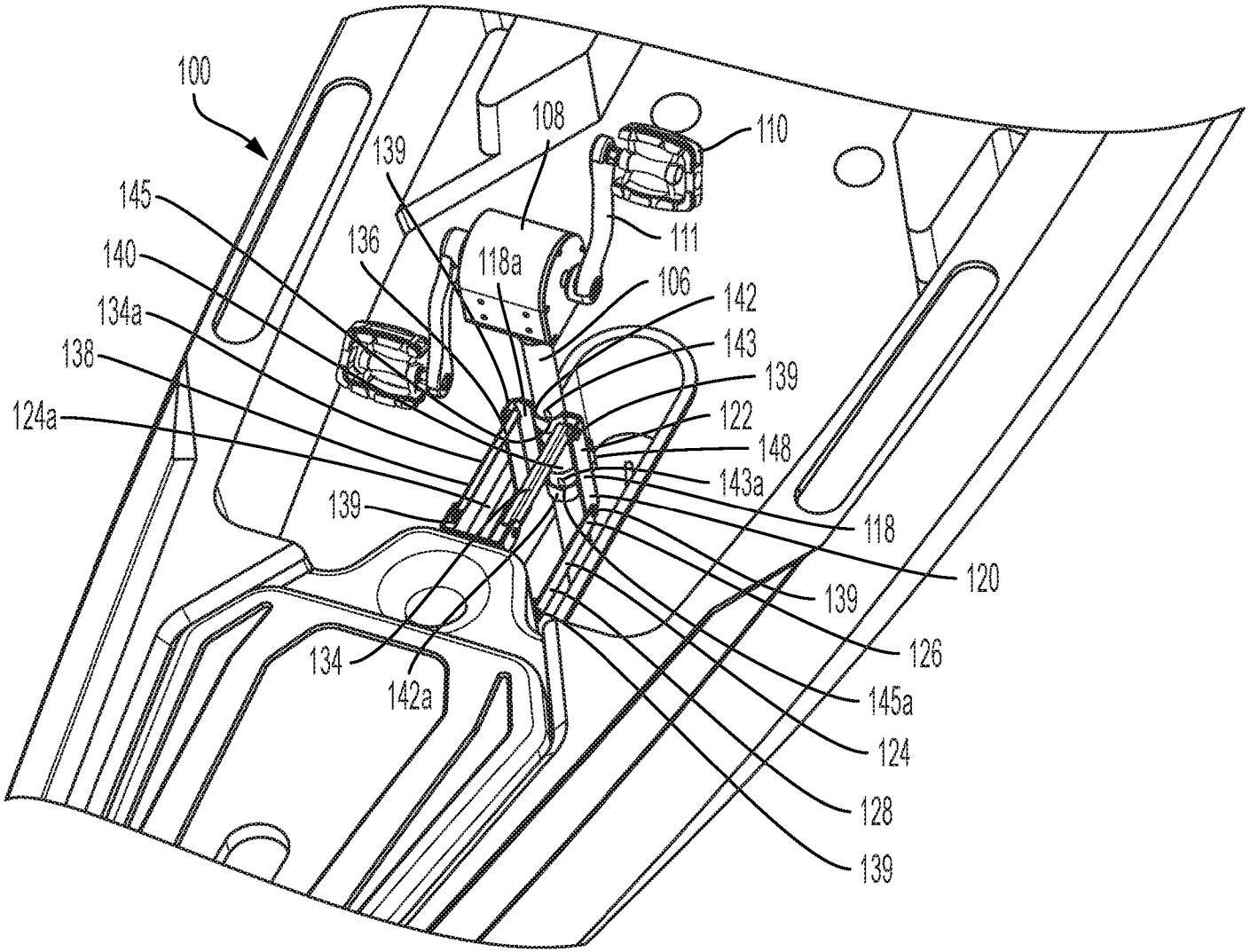
FIG. 3 is a front perspective view of an example implementation of a pedal drive mount system for watercraft of the present disclosure.
Figure 4:
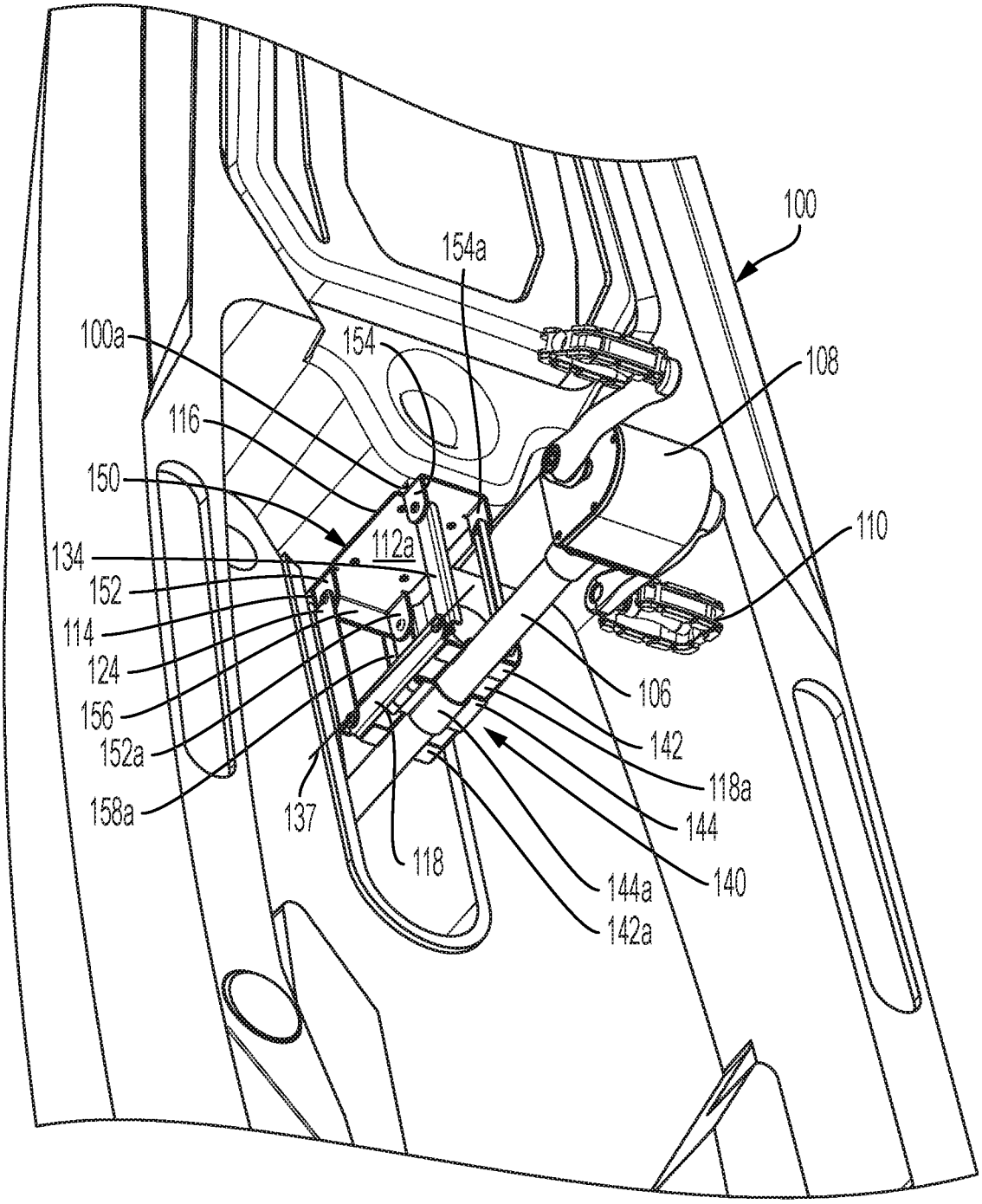
FIG. 4 is a left rear perspective view of an example implementation of a pedal drive mount system for watercraft of the present disclosure.
Figure 5:
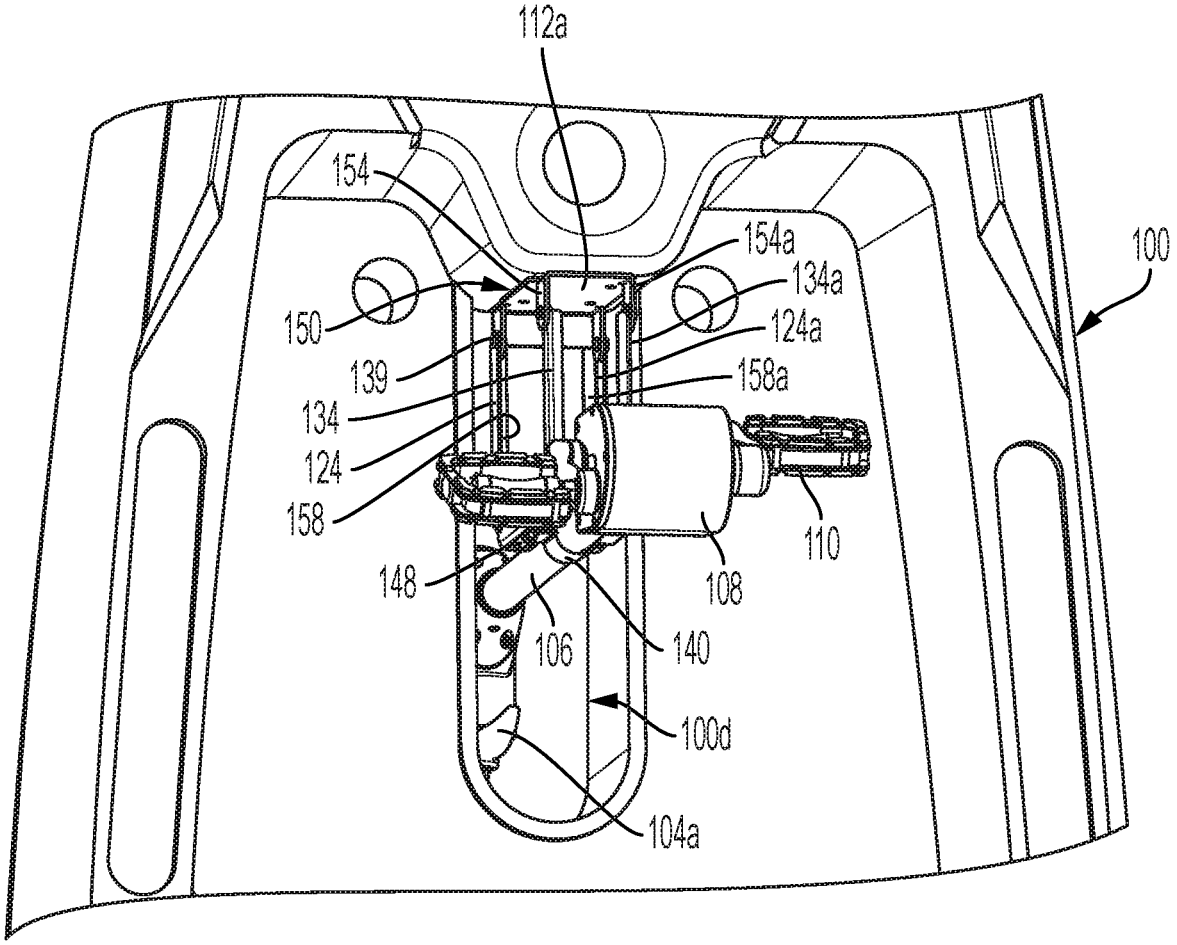
FIG. 5 is a top perspective view of an example implementation of a pedal drive mount system for watercraft of the present disclosure.

As shown in FIGS. 2 and 3, elongated link supports 118, 118*a* each have a lower portion 120 and an upper portion 122 spaced above the lower portion 120. Lower links 124, 124*a* each have a first portion 126 pivotally connected to the lower portion 120 of a link support 118, 118*a* respectively, and a second portion 128 pivotally connected to each side, respectively, of the lower portion of the mount portion 112. Upper links 134, 134*a* each have a first portion 136 connected to the upper portion 122 of a link support 118, 118*a*, respectively, and a second portion 138 pivotally connected by pivotal connectors (such as bolts, pins, etc.) 139 to each side, respectively, of the upper portion of the mount portion 112. The pivotal connectors 139 connecting first portion 126 of the lower link 124 and the first portion 136 of the upper link 134 together define an axis 137 therebetween as does also the pivotal connectors 139 connecting the first portion 126 of the lower link 124*a* and the first portion 136 of the upper link 134*a*.

Figure 6A:
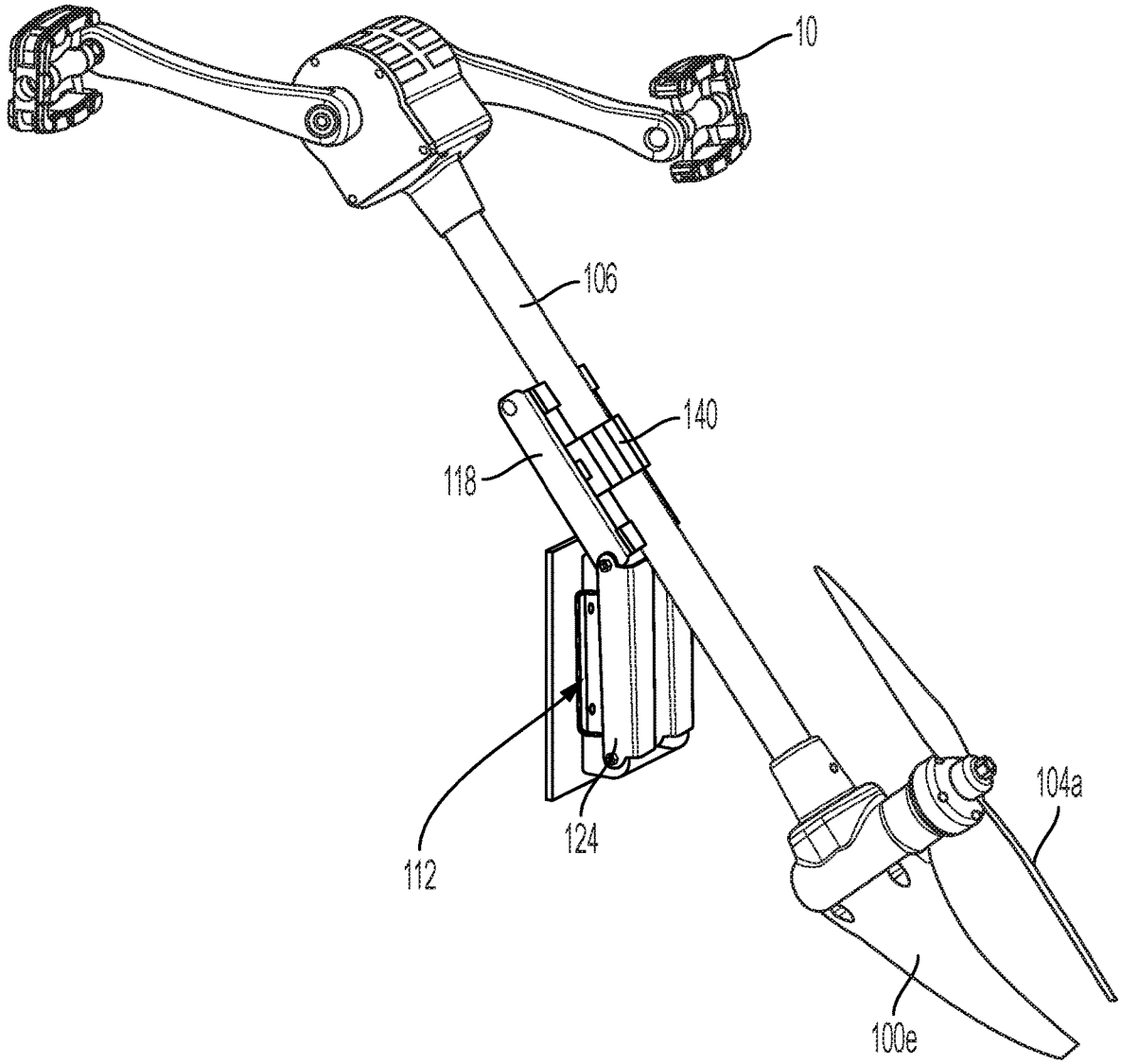
FIG. 6A is a schematic view of an example implementation of watercraft having an example implementation of a pedal drive mount system for watercraft of the present disclosure, wherein the pedal drive mount system is in the second position.
Figure 6B:
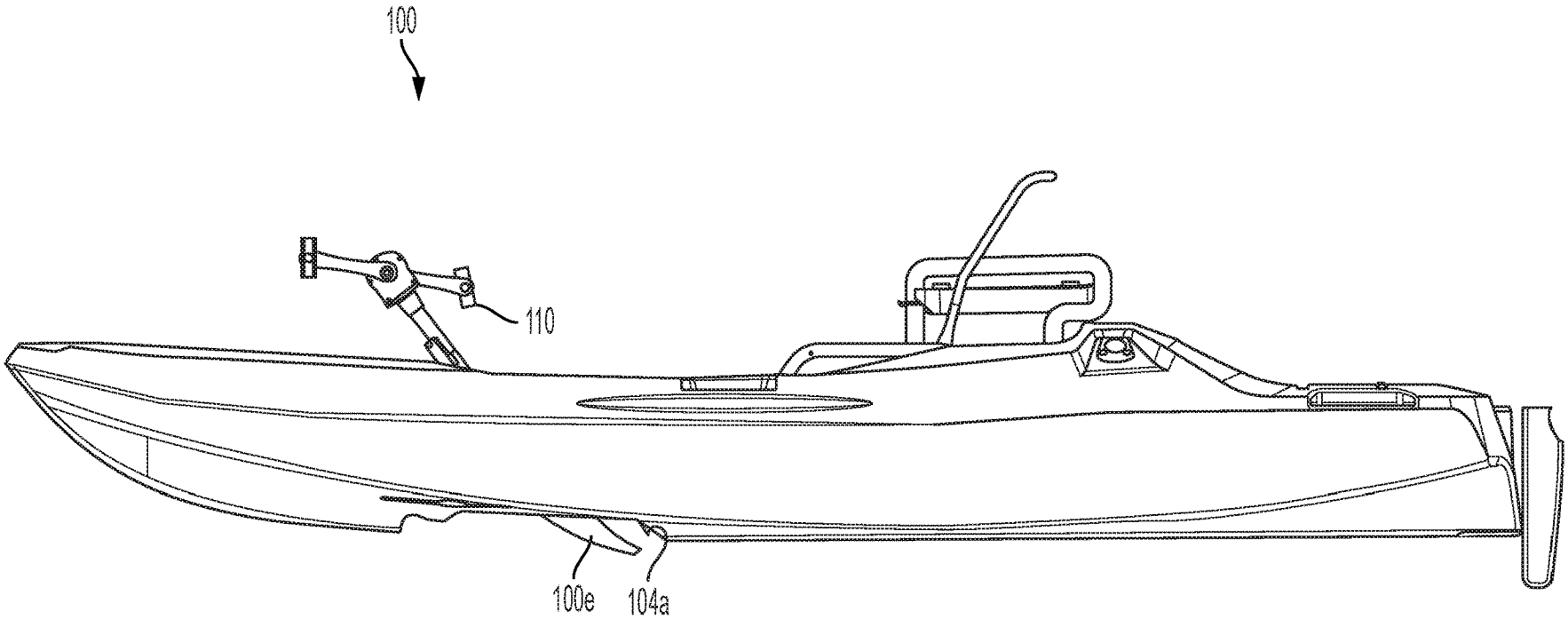
FIG. 6B is a schematic view of an example implementation of a pedal drive mount system for watercraft of the present disclosure in the second position.

The link supports 118, 118*a*, the upper links 134, 134*a*, and the lower links 124, 124*a* together form a four-bar linkage and are configured to allow the apparatus 10 to simultaneously move together between a first, extended, or deployed, operational position A (as shown in FIGS. 1-5), wherein the propeller 104*a* is in an operable position beneath kayak 100 for propelling the kayak 100, and the link supports 118, 118*a* are generally parallel to the mount portion 112, and a second, retracted, or stowed, position (as shown in FIGS. 6A and 6B), where the second, raised position B the link supports 118, 118*a* (with upper links 134, 134*a* being adjacent to and nested with link supports 118, 118*a*, respectively) are elevated with respect to the first position and are angled forwardly over mount portion 112, and the propeller 104*a* (and at least a portion of the skeg 100*e* of kayak 100) is raised upwardly from the operable position A to within opening 100*d* (FIGS. 5 and 6A) of kayak 100, and the link supports 118, 118*a* are closer to, and are angled at least partially forwardly over, the mounting portion 112 in the second position relative to the first position and wherein drive column 106 is angled at least partially forwardly over lower links 124, 124*a*, and upper links 134, 134*a*, and mounting portion 112. Consequently, pedals 110, crank arms 111, and drive unit 108 are also angled forwardly towards the front, or bow 100*b* (FIG. 2), of kayak 100, and propulsion unit 104 and propeller 104*a* are raised to provide an overall lower profile with respect to the bottom 100*c* of kayak 100. Apparatus 10 can be moved from the first, operational position A to the second, retracted position B by the user simply lifting up and pulling forward (towards the front of kayak 100) on the upper portion of propulsion system 102 by engaging and lifting pedals 110, crank arms 111, drive unit 108 and/or drive column 106, thereby causing drive column 106 to move upwardly through opening 100*d*.

A column clamp 140 is connected between link supports 118, 118*a* and is configured for receiving and substantially encompassing or surrounding at least a portion of the drive column 106, selectively fixing the drive column 106 with respect to the link supports 118, 118*a*, and selectively releasing the drive column 106 therefrom. Upon the column clamp 140 receiving and substantially surrounding at least a portion of the drive column 106, the lower link 124 and the upper link 134 are laterally spaced from a first side of the drive column 106 and the lower link 124*a* and the upper link 134*a* are laterally spaced from the opposite side of the drive column 106.

When apparatus 10 is in the first position A, column clamp 140 holds drive column 106 generally vertical, and parallel to mount portion 112, and a portion of column clamp 140 extends laterally generally coplanar with the link supports 118, 118*a*, and wherein the drive column 106, the link supports 118, 118*a*, the upper links 134, 134*a*, and the lower links 124, 124*a* are configured to simultaneously move together between the first position A and the second position B. Column cradles 142, 142*a* are configured for receiving and generally partially, or approximately halfway, surrounding the drive column 106. Upon drive column 106 being installed in column cradles 142, 142*a*, knobs, bumps, projections, ribs and/or lugs (referred to herein collectively as "lugs") 143, 143*a*, engage with recesses 145, 145*a*, respectively, defined in column cradles 142, 142*a*, respectively, to properly position drive column 106 at the preselected height with respect to link supports 118, 118*a* and also to properly orient drive column 106 such that pedals 110 extend along their length substantially perpendicularly with respect to the longitudinal axis 160 of kayak 100.

As shown in FIG. 3, column cradle 142*a* is positioned above column clamp 140, and column cradle 142*b* is positioned below column clamp 140. Column clamp 140 includes an elongated band or clamp member 144 defining a recess 144*a* configured to receive at least a portion of the drive column 106, wherein the clamp member 144 is pivotally connected to link support 118 at a hinge 148 element attached to link support 118. A releasable fastener, such as a bolt, clip, latch, hasp, etc. (none shown), allows clamp member 144 to pivot between an open position for receiving the drive column 106 and a secured, closed position surrounding drive column clamp 106 for securing drive column 106 to column clamp 140.

As referenced above, mount portion 112 extends generally vertically with respect to portion 100*a* of kayak 100. Mount portion 112 also, in certain implementations, including in cases where lower links 124, 124*a* and upper links 134, 134*a* are the same length, extends generally parallel to the drive column 106, upon the drive column 106 being received by the column clamp 140 and fixed with respect to the link supports 118, 118*a*.

Mounting portion 112, in certain implementations, may comprise a bracket, generally 150, having laterally extending back plate 112*a* for attachment to portion 100*a* of kayak 100. Extending from back plate 112*a* are lower projections 152, 152*a*, to which are connected the second portion 128, 128*a* of lower links, 124, 124*a*, respectively. Also extending from back plate 112*a* are upper projections 154, 154*a*, to which the second portion 138, 138*a* of upper links, 134, 134*a*, respectively, are pivotally connected. A ledge 156 extends from the back plate 112*a* between lower projection 152, 152*a*, respectively, and a flange 158 (FIGS. 4 and 5) on each lower link 124, 124*a* is configured for engaging the ledge 156, wherein upon such engagement of the flanges 158, 158*a* with the ledge 156, the lower links 124, 124*a* and the upper links 138, 138*a* extend generally perpendicular to the back plate 112*a*, and the lower links 124, 124*a* are each restrained from pivoting downwardly. This arrangement acts to hold the propulsion system 102 in the lowered, operable position A, in that the drive column 106 is maintained at the proper elevation for the user to use the pedals 110, i.e., generally vertically and generally perpendicular to the longitudinal axis 160 of kayak 100. Such arrangement also prevents the propulsion system from dropping to a lower elevation with respect to mounting portion 112 (and kayak 100). The weight of system 10 and propulsion system 102 serves to maintain same in the first position A. A releasable locking arrangement, such as a locking pin, latch, catch, etc., such as discussed below and shown in FIGS. 7-9, could be provided to further selectively secure system 10 and propulsion system 102 in lowered position A.

The lower links 124, 124*a* could be combined as a unitary member, and/or mounting portion 112 could be multiple members, if desired. Mounting portion 112 may be attachable to portion 100*a* of kayak 100 via pins, screws, bolts and/or other fasteners or connection arrangement, or, mounting portion could be integral with kayak 100, if desired.

Figure 7:
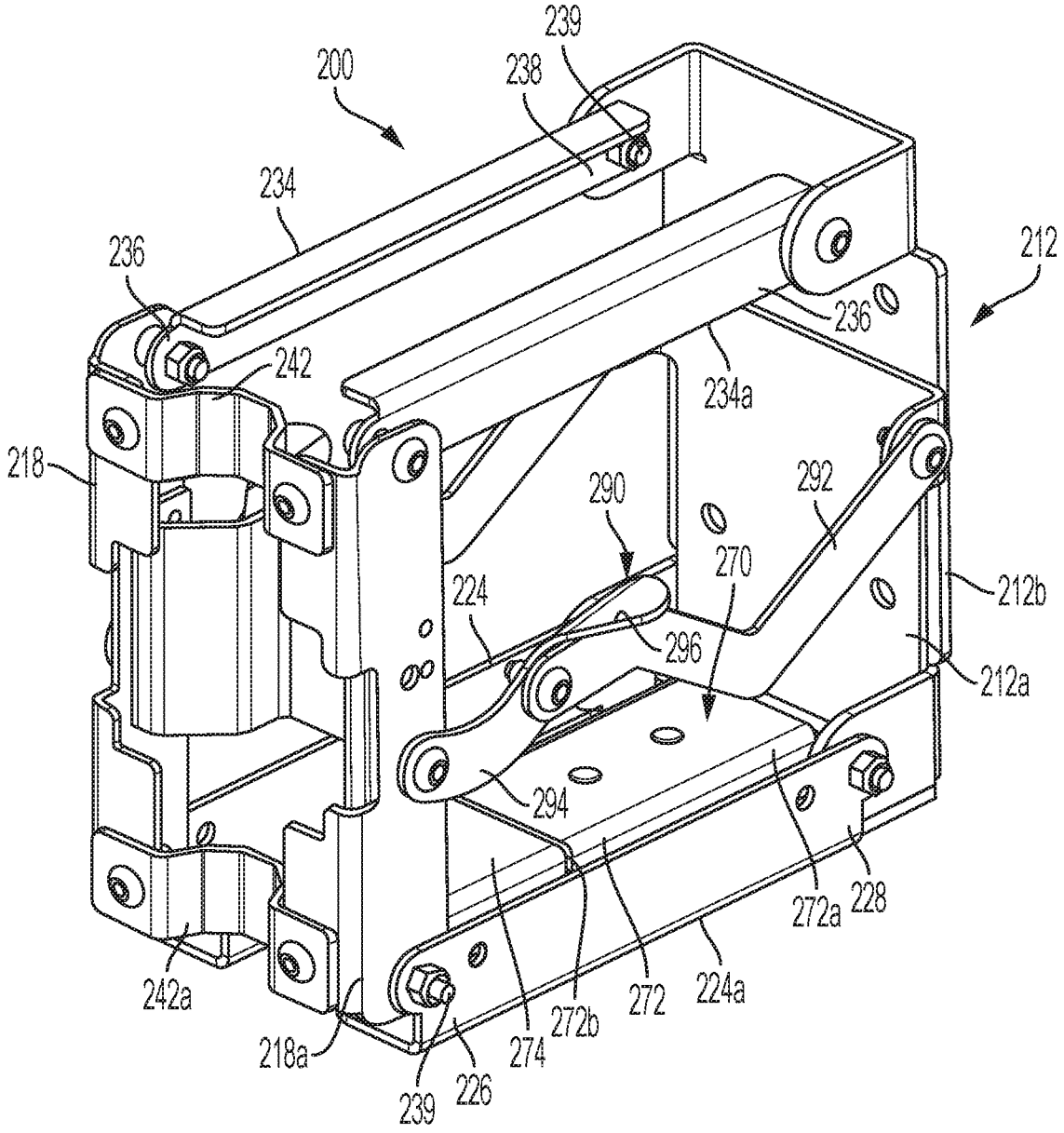
FIG. 7 is a perspective view of an alternate example implementation of a four-bar linkage component of a pedal drive mount system for watercraft of the present disclosure.

FIGS. 7-13 illustrate other example implementations of apparatus 10 in accordance with the present disclosure. In FIG. 7, a four-bar linkage arrangement, generally 200, is shown having an elongated mount portion, generally 212, having a lower portion and an upper portion spaced above the lower portion. Mount portion 212 includes a first, or back, plate 212*a* and a second plate 212*b* attached to first plate 212*a*. Mount portion 212 could be integral with or mounted, kayak 100. Elongated link supports 218, 218*a* each have a lower portion and an upper portion spaced above the lower portion. Lower links 224, 224*a* each have a first portion 226 pivotally connected to the lower portion of a link support 218, 218*a* respectively, and a second portion 228 pivotally connected to each side, respectively, of the lower portion of the mount portion 212. Upper links 234, 234*a* each have a first portion 236 connected to the upper portion of a link support 218, 218*a*, respectively, and a second portion 238 pivotally connected by pivotal connectors (such as bolts, pins, etc.) 239 to each side, respectively, of the upper portion of the mount portion 212.

Figure 9:
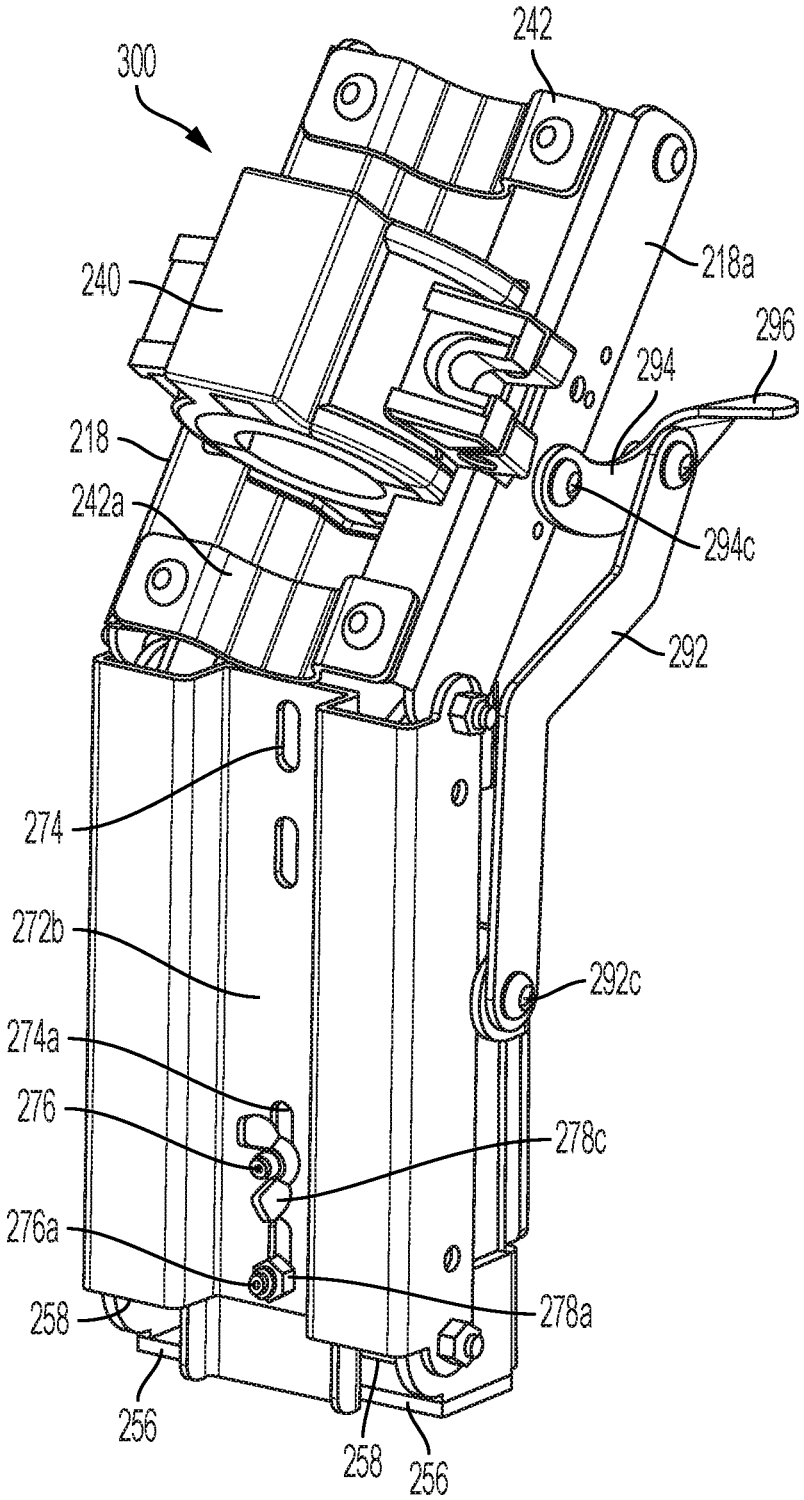
FIG. 9 is a perspective view of the alternate example implementation of FIG. 8 in the second position.

Four-bar linkage 200 also includes a base plate combination, generally 270, having a first base member, or plate, 272 with a first end 272*a* pivotally connected to mount portion 212, but having a second end 272*b* in sliding engagement and/or relation with respect to a second base member, or plate 274, which is adjacent to first plate 212*a*. Second base plate 274 spans between and is integral with lower links 224, 224*a*, and accordingly, moves with lower links 224, 224*a* as lower links 224, 224*a* pivot between positions A and B. As shown in FIG. 9, base second base plate 274 includes elongated slots 274*a* (FIG. 9) for receiving a bolts 276, 276*a*. In one example implementation bolt 276 threadingly receives a wingnut 278, and bolt 278*a* receives a nut. In a manner similar to four-bar linkage 20, four-bar linkage 200 is configured and operated by a use to allow drive column 106 to move between a first, extended, or deployed, operational position A and a second, retracted, or stowed, position, namely, position B. By tightening wingnut 278, the user may selectively tighten base plates 272, 274 together upon four-bar linkage 200 being in position A, position B, or an intermediate position therebetween, thereby locking four-bar linkage 200 in place.

Figure 8:
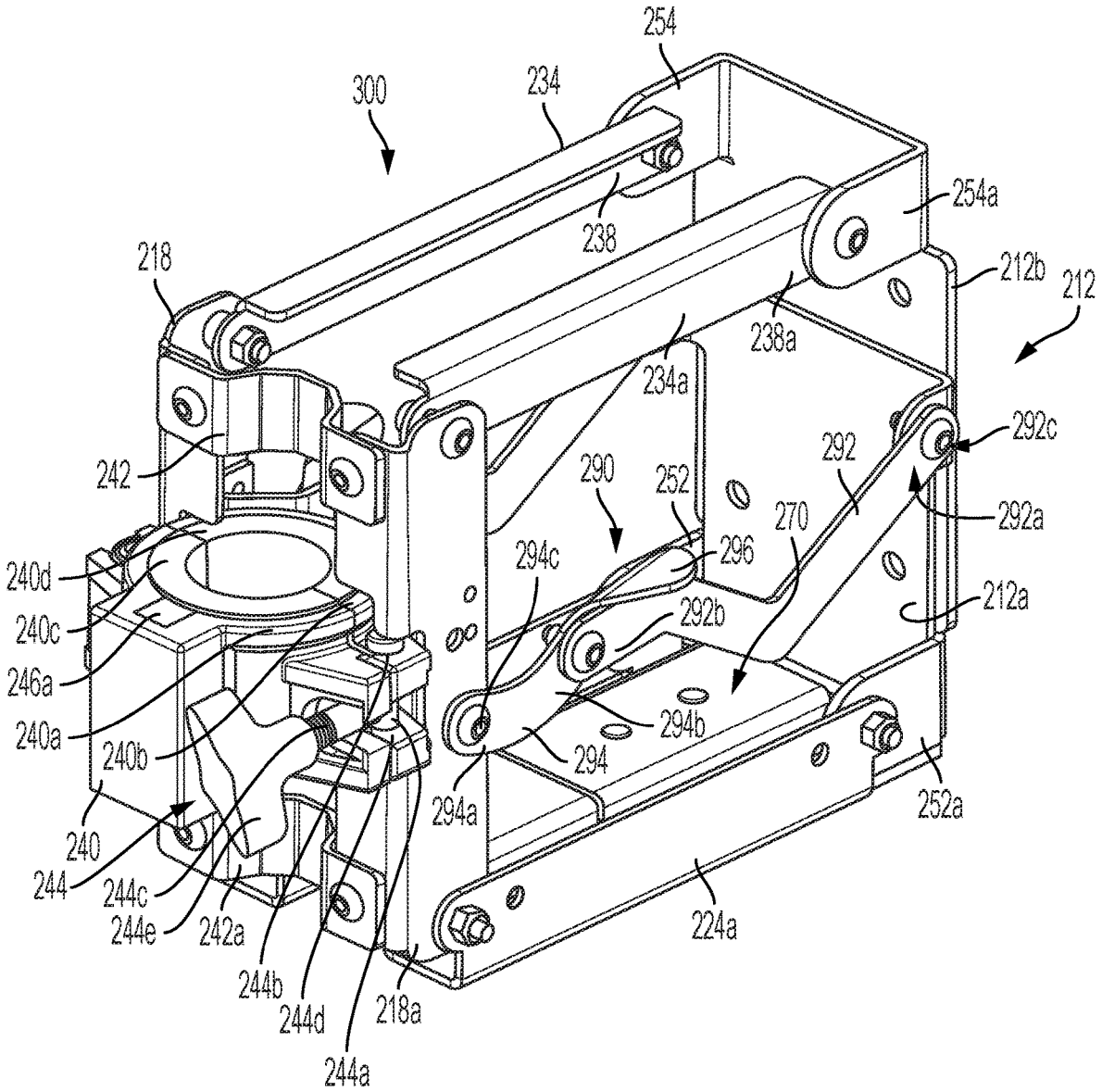
FIG. 8 is a perspective view of another alternate example implementation of a four-bar linkage component of a pedal drive mount system for watercraft of the present disclosure.

As shown in FIG. 8, another example implementation four-bar linkage 300 includes a column clamp 240 having portions 240*a* and 240*b* pivotally attached to one another for allowing column clamp 240 to move between an open position for receiving drive column 106 (where the respective ends of portions 240*a* and 240*b* are separated from one another) and a closed position for engaging drive column 106 (where the respective ends of portions 240*a* and 240*b* approach and/or are in contact with one another). Column clamp 240 is connected between link supports 218, 218*a* (clamp member portion 240*a* including a bolt 240*e* and wingnut 240*f* for attaching clamp 240 to four-bar linkage 300) and, like column clamp 140 discussed above, is configured for receiving and substantially surrounding at least a portion of the drive column 106, selectively fixing the drive column 106 with respect to the link supports 218, 218*a*, and selectively releasing the drive column 106 therefrom. A releasable fastener, such as a swing-bolt 244 having a post 244*a* pivotally carried in passage 244*b* and a threaded shaft 244*c* receivable in slot 244*d* of end of clamp member portion 240*a*, allows clamp 240 to pivot between an open position for receiving the drive column 106 and a secured, closed position (where wingnut 244*e* is tightened against end of clamp member portion 240*b*) surrounding drive column clamp 106 for securing drive column 106 to column clamp 240. Other fastening arrangements could be used instead of, or in addition to, swing-bolt 244, such as a clip, latch, hasp, etc. (none shown).

Clamp member portions 240*a* and 240*b* include a semi-cylindrical yoke portion 240*c*, 240*d*, each having a longitudinally extending ridge 246*a* received in an elongated channel 240*g* in each of clamp member portions 240*a*, 240*b*. Removal of one or both of yoke portions 246 allows column clamp 240 to accommodate a drive column 106 of a larger diameter and/or a differing cross-sectional configuration, if desired.

In a manner similar to column cradles 142, 142*a*, column cradles 242, 242*a*, are configured for receiving and generally partially, or approximately halfway, surrounding the drive column 106. Upon drive column 106 being installed in column cradles 142, 142*a*, lugs 143, 143*a*, engage with column cradles 242, 242*a*, respectively, to properly position drive column 106 for use, as discussed above.

Extending from back plate 212*a* are upper projections 254, 254*a*, to which the second portion 238, 238*a* of upper links, 234, 234*a*, respectively, are pivotally connected. Ledges 256 extend from the back plate 212*a* (FIG. 9) adjacent lower projections 252, 252*a*, respectively, and a flange 258 (FIGS. 7-9) on each lower link 224, 224*a* is configured for engaging a respective ledge 256, wherein upon such engagement of the flanges 258 with the respective ledge 256, the lower links 224, 224*a* and the upper links 234, 234*a* extend generally perpendicular to the back plate 212*a*, and the lower links 224, 224*a* are each restrained from pivoting downwardly. This arrangement acts in a manner similar to that discussed above with regard to four-bar linkage 20 arrangement to hold the drive column 106 in the lowered, operable position A, in that the drive column 106 is maintained at the proper elevation for the user to use the pedals 110, i.e., generally vertically and generally perpendicular to the longitudinal axis 160 of kayak 100. Such arrangement also prevents the propulsion system from dropping to an undesirable elevation.

As shown in FIGS. 7-9, a releasable locking arrangement, generally, 290, can be provided to further selectively secure the drive column 106 in lowered position A. The locking arrangement 290 may include a toggle lock configuration having arms 292, 294 pivotally connected to one or both sides of four-bar linkage arrangements 200, 300. First arm 292 has a first end 292*a* pivotally connected to back plate 212*a* and a second end 292*b* pivotally connected to a first end 294*a* of a second arm 294, which, in turn, has a second end 294*b* pivotally connected to link support 218 or 218*a*. The first end 294*a* of the second arm 294 includes an outwardly-extending tab 296 which, when depressed, because of an over-center, or, toggle lock, configuration of the locking arrangement 290 forces the ends 292*a* and 294*b* outwardly to place arms 292, 294 in compression. This, in turn, serves to fix the four-bar linkage arrangement from movement. To release, or unlock, the locking arrangement 290, the tab 296 is lifted sufficient to release the compression in arms 292, 294, thereby allowing arms 292, 294 to again pivot, and the four-bar linkage arrangement to then be movable towards position B.

Instead of, or in addition to, the locking arrangement 290, lift assist devices, such as springs, air cylinders, etc. (none shown) could replace the locking arrangement 290 to aid in the user's raising of the drive column 106 from the deployed position to the retracted position. In one example implementation, such springs or air cylinder could be attached to and extend between the pin, bolt, etc. pivot point 292*c* where end 292*a* of arm 292 is attached to the back plate 212*a* and the pin, bolt, etc. pivot point 294*c* where end 294*a* of arm 294 is attached to the link support.

Figure 10:
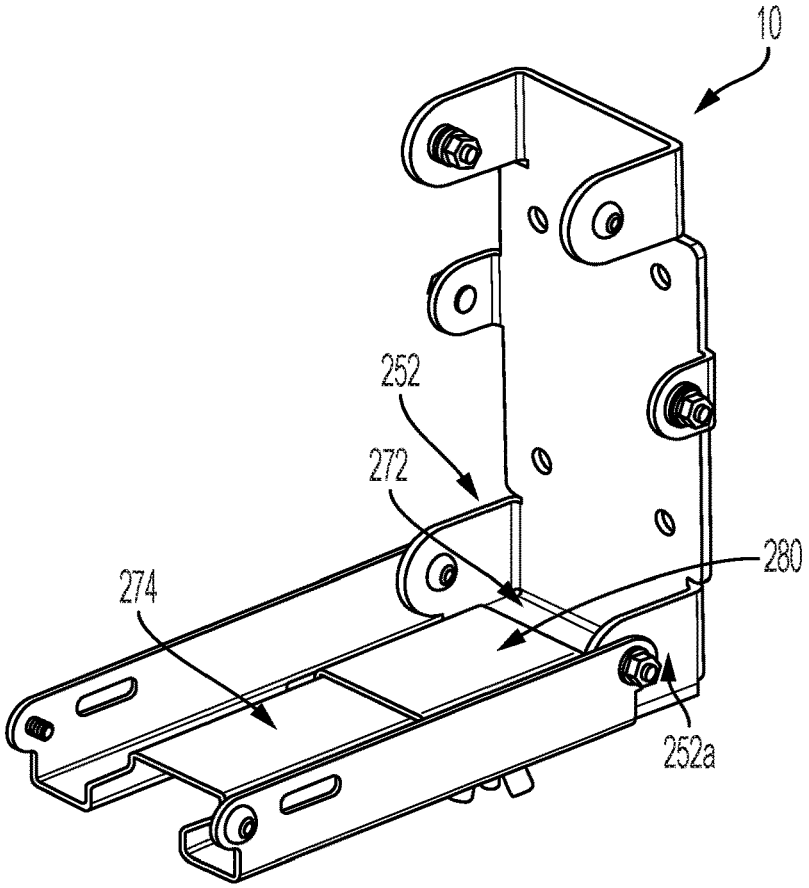
FIG. 10 is a perspective view of an alternate example implementation of a four-bar linkage for a pedal drive mount system for watercraft of the present disclosure.
Figure 11:
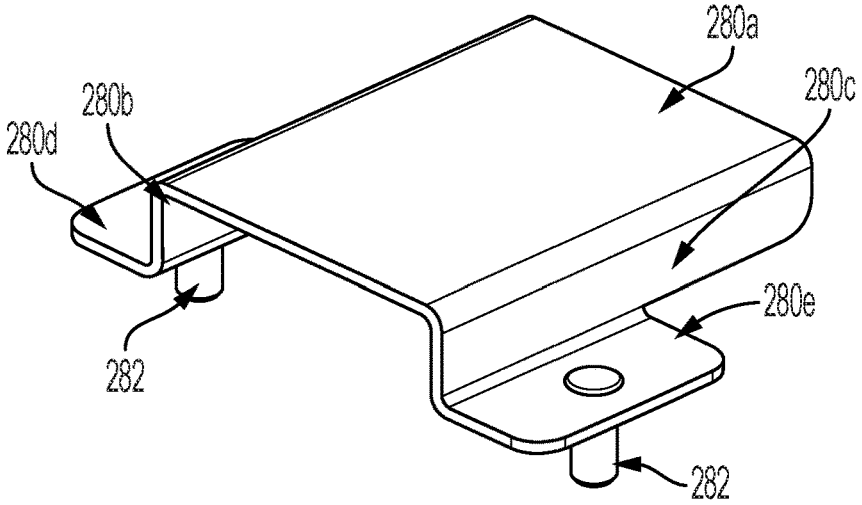
FIG. 11 is a perspective view of a locking member component of the four-bar linkage shown in FIG. 10.

FIGS. 10-13 illustrate other example implementations of apparatus 10 in accordance with the present disclosure. FIG. 10 is a perspective view of an alternate example implementation of a four-bar linkage for a pedal drive mount system for watercraft of the present disclosure having a sliding locking member component 280, which includes a plate having a generally inverted flattened U-shape with an upper panel 280*a* with downwardly extending side panels 280*b*, 280*c*, each having an outwardly extending flange 280*d*, 280*e*, respectively, extending therefrom. Extending generally perpendicularly outwardly from each flange 280*d*, 280*e* is a post 282. Flanges 280*d*, 280*e*, are slidingly received relative to each of lower links 224, 224*c*.

Figure 12:
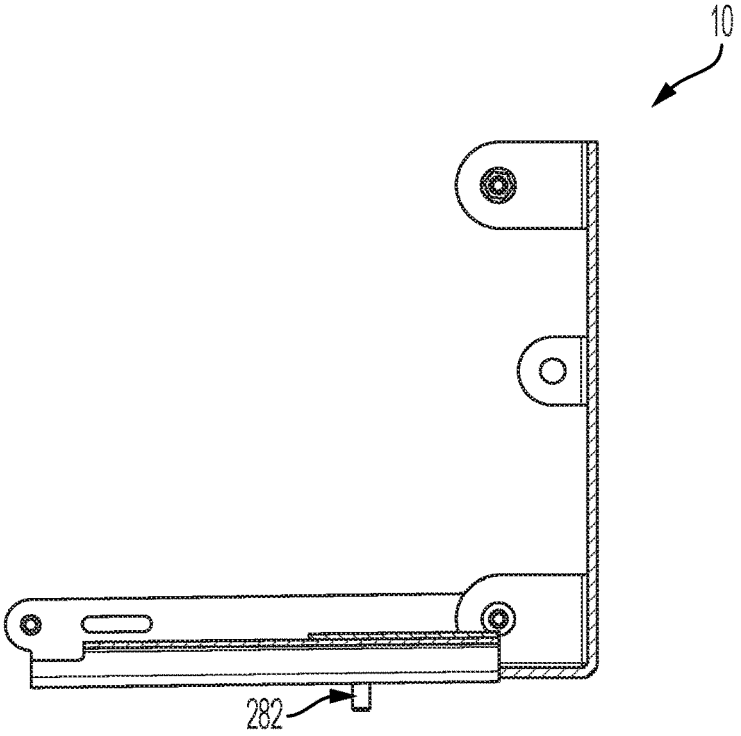
FIG. 12 is a schematic view of the locking member component shown in FIG. 11 in a first, unlocking position in an example four-bar linkage.
Figure 13:
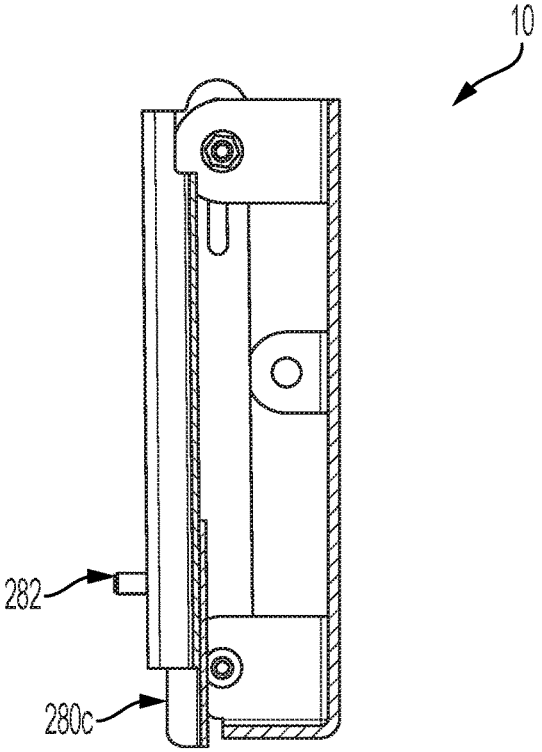
FIG. 13 is schematic view of the locking member component shown in FIG. 11 in a second, locking position in an example four-bar linkage.

In an example implementation, locking member component 280 slidingly straddles first base plate 272 and/or second base plate 274 and is movable between a, first, unlocking position, as shown in FIGS. 10 and 12, to a second, locking position, shown in FIG. 13, where the four-bar linkage is in the extended, operable position for operating the propulsion system 102. In the locking position, the four-bar linkage is in the retracted, stowed position, where locking member component 280 automatically moves or slides downwardly to the position shown in FIG. 13 due to the force of gravity and/or is manually moved downwardly through engagement of one or more of posts 282 by the user. In this second, locking position, upper panel 280*a* movement engages with lower projections 252, 252*a* to physically block the four-bar linkage from moving towards the extended, operable position.

Four-bar linkage arrangements 200, 300 can be selectively locked in the stowed position using a bolt/wingnut 276, 278*c* combination, as shown in FIG. 9, or by various other lacking devices, such as clips, pins, twist locks, toggle locks (none shown) and/or the like.

The above-disclosed features and functions, as well as alternatives, may be combined into many other different apparatuses or applications. Various presently unforeseen or unanticipated alternatives, modifications, variations or improvements may be made by those skilled in the art, each of which is also intended to be encompassed by the disclosed implementations.

The invention claimed is:

1. An apparatus for mounting a propulsion system to a watercraft, the apparatus comprising:

an elongated mount portion configured to be attached to a watercraft, the mount portion having a lower portion and an upper portion spaced above the lower portion of the mount portion;

at least one elongated link support having a lower portion and an upper portion spaced above the lower portion of the link support;

a first arm and a second arm, the first arm having a first portion pivotally connected to the link support and a second portion pivotally connected to the second arm, and the second arm having a first portion connected to the mount portion, wherein the first arm and the second arm are configured to form a toggle lock, such that upon selective depression of the first portion of the first arm, the first arm, the second arm, or both the first arm and the second arm is placed in compression with respect to at least one of the link support and the mount portion;

at least one link pivotally connected to the link support and pivotally connected to the mount portion;

the link support, the at least one link, the first arm, and the second arm being configured to move between a first position where the link support is generally parallel to the mount portion, and a second position where the second position is elevated above the first position; and at least one column clamp configured for receiving and substantially surrounding a drive column of the propulsion system of the watercraft and selectively fixing the drive column with respect to the link support.

2. The apparatus of claim 1, wherein the at least one link comprises:

at least one lower link having a first portion pivotally connected to the lower portion of the link support and a second portion pivotally connected to the lower portion of the mount portion;

at least one upper link having a first portion connected to the upper portion of the link support and a second portion pivotally connected to the upper portion of the mount portion; and the first portion of the at least one lower link and the first portion of the at least one upper link defining an axis therebetween.

3. The apparatus of claim 2, wherein:

the at least one lower link includes a first lower link and a second lower link;

the at least one upper link includes a first upper link and a second upper link;

the at least one link support includes a first link support and a second link support; and the column clamp extends between the first link support and the second link support, wherein upon the column clamp receiving and substantially surrounding the drive column, the first lower link and the first upper link are laterally spaced from a first side of the drive column and the second lower link and the second upper link are laterally spaced from a second side of the drive column, wherein the second side of the drive column is opposite the first side.

4. The apparatus of claim 2, wherein the mount portion, the link support, the lower link and the upper link together form a four-bar linkage.

5. The apparatus of claim 1, further comprising a locking member movable between a locked position for securing the link support, the at least one link, the first arm, and the second arm in the second position, and an unlocked position for allowing movement of the link support, the at least one link, the first arm, and the second arm from the second position.

6. The apparatus of claim 5, wherein the locking member comprises a plate configured to be slidingly received in the at least one link and to move with respect to the at least one link between the locked position and the unlocked position.

7. The apparatus of claim 5, wherein the locking member comprises:

the locking member being configured to be slidingly received in the at least one link and to move with respect to the at least one link between the locked position and the unlocked position; and at least one releasable fastener for selectively securing the locking member to the at least one link in the closed position.

8. The apparatus of claim 1, wherein:

the column clamp comprises a first portion and a second portion; the first portion being pivotally connected to the second portion; the first portion of the column clamp being configured to move between an open position for receiving drive column and a closed position for engaging drive column; and a releasable fastener for selectively securing the clamp in the closed position.

9. The apparatus of claim 1, wherein:

the column clamp comprises:

a first portion having a first yoke configured for receiving the drive column;

a second portion having a second yoke configured for receiving the drive column; the first portion being pivotally connected to the second portion, and the first portion of the column clamp being configured to move between an open position for receiving drive column and a closed position for engaging drive column; and the first portion defining an elongated channel, and the first yoke having a ridge configured to be received in an elongated channel; and a releasable fastener for selectively securing the clamp in the closed position.

10. The apparatus of claim 1, wherein the elongated mount portion comprises:

a first plate configured to be attached to a watercraft; and a second plate configured to be attached to the first plate, wherein, the first portion of the second arm is pivotally connected the first plate and the at least one link is pivotally connected the first plate.

11. The apparatus of claim 1, wherein upon the drive column being received by the column clamp and fixed with respect to the link support, the link support is configured to extend generally coplanar with the drive column.

12. The apparatus of claim 1, wherein, the link support, the at least one link, the first arm, and the second arm are configured such that the link support is at least partially angled over the mounting portion in the second position relative to the first position.

13. The apparatus of claim 1, further comprising:

at least one column cradle configured for receiving and surrounding at least a portion of the drive column;

at least one lug on the drive column; and the column cradle defining a recess configured to receive the lug, wherein, upon the drive column being received in the column cradle, the lug is received in the recess of the column cradle for positioning the drive column at a certain height with respect to the link support.

14. An apparatus for mounting a propulsion system to a watercraft, the apparatus comprising:

an elongated mount portion configured to be attached to a watercraft; the mount portion having a lower portion and an upper portion spaced above the lower portion of the mount portion;

at least one elongated link support having a lower portion and an upper portion spaced above the lower portion of the link support;

at least one lower link having a first portion pivotally connected to the lower portion of the link support and a second portion pivotally connected to the lower portion of the mount portion;

at least one upper link having a first portion connected to the upper portion of the link support and a second portion pivotally connected to the upper portion of the mount portion;

the first portion of the lower link and the first portion of the upper link defining an axis therebetween;

a first arm and a second arm, the first arm having a first portion pivotally connected to the link support and a second portion pivotally connected to the second arm, and the second arm having a first portion connected to the mount portion, wherein the first arm and the second arm are configured to form a toggle lock, such that upon selective depression of the first portion of the first arm, the first arm, the second arm, or both the first arm and the second arm is placed in compression with respect to at least one of the link support and the mount portion;

the mount portion, the link support, the lower link and the upper link being configured to together form a four-bar linkage; and the link support, the upper link, and the lower link being configured to simultaneously move together between a first position, wherein the link support is generally parallel to the mount portion, and a second position, wherein the second position is elevated above the first position; and at least one column clamp configured for receiving and substantially surrounding a drive column and selectively fixing the drive column with respect to the link support.

15. The apparatus of claim 14, further comprising at least one column cradle configured for receiving and generally surrounding at least a portion of the drive column of the propulsion system of the watercraft.

16. The apparatus of claim 14, wherein:

the column clamp comprises:

a first portion having a first yoke configured for receiving the drive column;

a second portion having a second yoke configured for receiving the drive column; the first portion being pivotally connected to the second portion, and the first portion of the column clamp being configured to move between an open position for receiving the drive column and a closed position for engaging the drive column; and the first portion defining an elongated channel, and the first yoke having a ridge configured to be received in an elongated channel; and a releasable fastener for selectively securing the clamp in the closed position.

17. The apparatus of claim 14, further comprising:

a locking member configured to move within the at least one lower link between a locked position for securing the link support, the at least one upper link, the at least one lower link, the first arm, and the second arm in the second position, and an unlocked position for allowing movement of the link support, the at least one upper link, the at least one lower link, the first arm, and the second arm from the second position; and at least one releasable fastener for selectively securing the locking member to the at least one lower link in the closed position.

18. A watercraft, comprising:

a propulsion system including:

a propulsion unit, and a drive column connected to the propulsion unit;

an elongated mount portion having a lower portion and an upper portion spaced above the lower portion of the mount portion;

at least one elongated link support having a lower portion and an upper portion spaced above the lower portion of the link support;

at least one lower link having a first portion pivotally connected to the lower portion of the link support and a second portion pivotally connected to the lower portion of the mount portion;

at least one upper link having a first portion connected to the upper portion of the link support and a second portion pivotally connected to the upper portion of the mount portion;

the first portion of the lower link and the first portion of the upper link defining an axis therebetween;

the link support, the upper link, and the lower link being configured to simultaneously move together between a first position, wherein the link support is generally parallel to the mount portion, and a second position, wherein the second position is elevated above the first position, and the link support is closer to the mounting portion in the second position relative to the first position;

at least one column clamp configured for receiving and substantially surrounding at least a portion of the drive column and selectively fixing the drive column with respect to the link support;

a locking member configured to move within the at least one lower link between a locked position for securing the link support, the at least one upper link, and the at least one lower link in the second position, and an unlocked position for allowing movement of the link support, the at least one upper link, and the at least one lower link from the second position; and at least one releasable fastener for selectively securing the locking member to the at least one lower link in the closed position.

19. The watercraft of claim 18, further comprising a first arm and a second arm, the first arm having a first portion pivotally connected to the link support and a second portion pivotally connected to the second arm, and the second arm having a first portion connected to the mount portion, wherein the first arm and the second arm are configured to form a toggle lock, such that upon selective depression of the first portion of the first arm, at least one of the first arm and the second arm is placed in compression with respect to at least one of the link support and the mount portion.

20. The watercraft of claim 18, wherein:

the column clamp comprises:

a first portion having a first yoke configured for receiving the drive column;

a second portion having a second yoke configured for receiving the drive column; the first portion being pivotally connected to the second portion, and the first portion of the column clamp being configured to move between an open position for receiving drive column and a closed position for engaging drive column; and the first portion defining an elongated channel, and the first yoke having a ridge configured to be received in an elongated channel; and a releasable fastener for selectively securing the clamp in the closed position.

* * * * *